United States Patent [19]

Hirabayashi et al.

[11] 4,403,852

[45] Sep. 13, 1983

[54] DEVELOPER RECOVERING DEVICE FOR ELECTROSTATIC IMAGE REPRODUCING SYSTEM

[75] Inventors: Tsugio Hirabayashi; Junichi Koiso, both of Hachioji, Japan

[73] Assignee: Konishiroku Photo Industry Co., Ltd., Tokyo, Japan

[21] Appl. No.: 326,510

[22] Filed: Dec. 2, 1981

[30] Foreign Application Priority Data

Dec. 20, 1980 [JP] Japan ..... 55-179693

[51] Int. Cl.[3] ..... G03G 15/09

[52] U.S. Cl. ..... 355/15; 355/3 DD; 355/3 BE; 355/14 D; 118/658

[58] Field of Search ..... 355/3 DD, 14 D, 15, 355/3 BE, 16, 35 C; 118/658

[56] References Cited

U.S. PATENT DOCUMENTS

| | | | |
|---|---|---|---|
| 3,697,160 | 10/1972 | Clark | 355/3 BE |
| 3,726,588 | 4/1973 | Moser | 355/16 X |
| 3,926,517 | 12/1975 | Nagahara | 355/15 X |
| 4,110,034 | 8/1978 | Suzuki | 355/15 |
| 4,144,808 | 3/1979 | Iwasa et al. | 355/3 BE |
| 4,252,435 | 2/1981 | Manghirmalani | 355/15 |
| 4,279,499 | 7/1981 | Rezanka et al. | 355/15 |
| 4,298,268 | 11/1981 | Sato et al. | 355/3 SC |
| 4,370,056 | 1/1983 | Hays | 355/3 DD |

*Primary Examiner*—A. C. Prescott

*Attorney, Agent, or Firm*—Frishauf, Holtz, Goodman and Woodward

[57] ABSTRACT

An electrostatic image reproducing system includes a developing unit, a rotatable photosensitive drum, a cleaning unit, and a developer recovering device for recycling developer containing a magnetic ingredient from the cleaning unit to the developing unit.

The developer recovering device includes a developer conveying device including a revolving element made of a non-magnetic material and having an outer surface, and a plurality of magnets arranged adjacent the inner surface of the circumference of the revolving element, and a casing encircling at least a portion of the outer surface of the revolving element with a given spacing therebetween for receiving developer containing the magnetic ingredient. The revolving element is arranged to pick up developer from the casing by the magnetic power of the magnets, and the picked up developer is conveyed to the developing unit by the revolving element as ears of developer on the revolving element.

10 Claims, 5 Drawing Figures

DEVELOPER RECOVERING DEVICE FOR ELECTROSTATIC IMAGE REPRODUCING SYSTEM

BACKGROUND OF THE INVENTION

1. Field of the Invention

This invention relates to a developer recovering device which automatically recycles a developer collected by a cleaning unit of an image reproducng system.

2. Description of the Prior Art

A developer recovering device that is provided with a developer conveying passages to return a developer collected by a cleaning unit to a developing unit in which a screw conveyer or a chain conveyer is equipped is well known.

Problems with such a prior developer recovering device are extreme deterioration of developing quality of the recovered developer which has been subjected to extreme friction or pressure caused by a narrow interval between the conveying passage and the conveying means; and the consequent deteriorated developing operation with resultant low image quality caused by increased quantities of such a recycled deteriorated developer.

SUMMARY OF THE INVENTION

It is an object of the present invention to solve such problems as explained in the above.

This invention relates to a developer recoverying device for an electrostatic image reproducing system to recycle to a developing unit a developer containing a magnetic ingredient which is collected by a cleaning unit. The developer recovering device comprises a revolving element made of a non-magnetic material and arranged with magnets in the inner surface of the circumference of the revolving element, and a casing for encircling the revolving element with a certain gap therebetween, whereby the revolving element can absorb and convey a developer which has been dropped into the casing by ears of a developer by a magnetic power of the magnets.

In the developer recovering device of our invention, if necessary, a conveyor made of a non-magnetic material may be wound around a circumferential surface of the revolving element and the conveyer is driven by the revolving element. The heads of the magnets in the revolving element may either be exposed or totally buried in the circumference. The use of such a conveyor belt is desirable in increasing flexibility of the conveying passage and making a developer drop into the developing unit easily.

Either the conveyer belt installed in to the revolving element or the revolving element conveys a part of the developer of the developing unit to the cleaning device by depositing the developer on the surface of the revolving element by means of the magnets and conveys the developer collected in the cleaning device to the developing unit by depositing the developer on the surface by means of the magnets directly or indirectly.

The casing covers at least the conveyor belt placed between the cleaning device and the developing unit or the outer part of the revolving element, with an interval or gap between the casing and the device to form a conveying passage for the developer within an appropriate range satisfying the purpose of the present invention. When the interval or gap is set excessively wide, during the process of absorbing and conveying a part of the developer from the developing unit to the cleaning unit, by absorbing on the conveyor belt or the revolving element by the magnets, the developer drops and accumulates at the bottom of the casing area, said and consequently interferes with conveyance of the developer. On the other hand, an excessively narrow interval or gap causes clogging by friction with the casing.

In the present invention, the interval or gap between the conveyer belt and the casing or between the revolving element and the casing is set in such a range that permits collection and conveyance of the developer dropped to the bottom of the casing area by ears of the developer absorbed and formed on the surface of the conveyer or the revolving element.

Although such intervals (or distance) vary according to the magnitudes of a magnetic power and a composition of the developer, it is desirable to set the gap in a range between approximately not more than 1.5 times or preferably 1.2 times, or most desirably, not more than 1.0 times of the height of the ears and not less than $\frac{1}{3}$ or preferably $\frac{1}{2}$ of the height of the ears when the revolving element is at a standstill. The above intervals concern the area under the horizontal line which passes through the center of the revolving element. In the area above this horizontal line, the lower limits of this interval can be more than $\frac{1}{3}$ or more preferably, more than $\frac{1}{2}$ of the height of the ears, but with no specific upper limits.

In the present invention, for instance, when using a developer of which the main ingredient is magnetic toner which does not need a carrier, it is not necessary to use the conveyer belt, and the revolving element having the magnets in, the inner circumference, directly conveys the developer collected by the cleaning unit and recovery of the developer is performed, for example, by separating it by means of a slanted doctor blade set near the developing unit. In this case, although a major part of the developer collected is recovered to the developing unit by, being conveyed along the upper circumference of the revolving element, a part of the developer collected during the cleaning process, flows down along the revolving element in the casing and accumulates at the bottom of the casing. Said accumulated developer disturbs smooth rotating of the revolving element and deteriorates the developer due to friction with the revolving element which is eventually recovered to the developing unit, thereby spoiling developing performance of the developer. Consequently, in this case, exactly in the similar way as in cases where the conveyor belt is employed, the problems can be solved by setting the interval in the casing bottom area or the area under the horizontal line passing through the center of the revolving element between not less than $\frac{1}{3}$ or more preferably $\frac{1}{2}$ of the height of the ears formed by the magnets in the revolving element when it is at a standstill and not more than 1.5 times, or preferably 1.2 times or more advantageously, not more than 1.0 times the ear height.

DETAILED DESCRIPTION OF THE PREFERRED EMBODIMENTS

Figure 1:
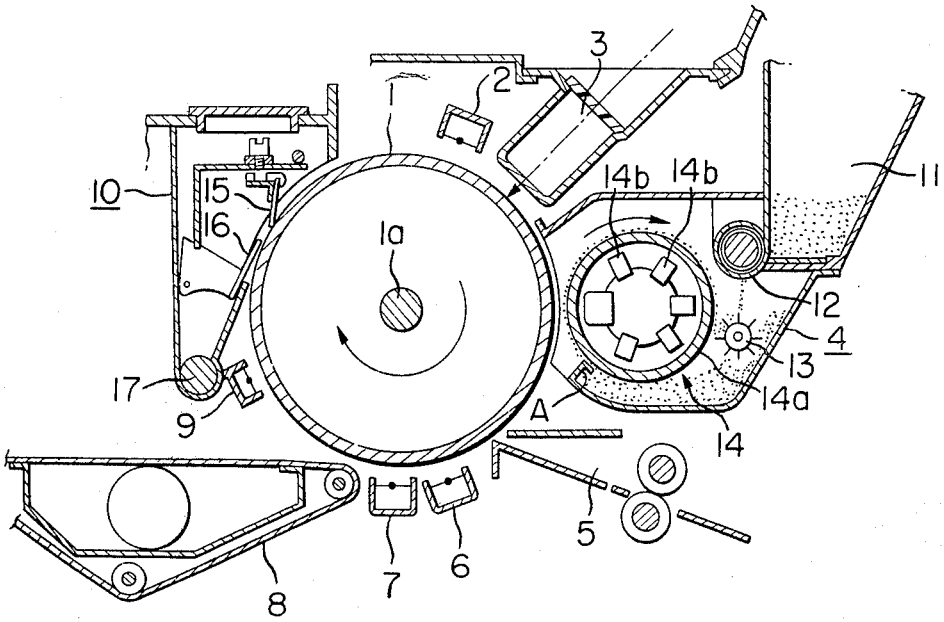
FIG. 1 is a sectional drawing of the main part of an electrostatic image reproducng apparatus employing a photosensitive drum to which the invention pertains.

In FIG. 1, numeral 1 represents a photosensitive drum which rotates in the direction shown by an arrow, numeral 2 represents a charged electrode, numeral 3 represents an exposed optical system, numeral 4 represents a developing unit, numeral 5 represents a paper feeding unit, numeral 6 represents a transfer electrode, numeral 7 represents a separation electrode, numeral 8 represents a paper conveying device, numeral 9 represents a charge eliminating electrode, and numeral 10 represents a cleaning equipment.

In this apparatus, either a powder developer containing a toner and a magnetic carrier or a powder developer containing magnetic ingredients in the toner particle is used. The developing unit 4 comprises a developer replenishing hopper 11, a receiving and distribution unit 12 which by means of a screw conveyer receives a developer from the developer recovering device as described hereafter and drops and distributes the developer uniformly over the whole width of the developing unit, a mixing unit 13 and a magnetic brush unit 14. The magnetic brush unit 14 comprises a plurality of magnets 14*b* arranged at regular intervals in inside the revolving sleeve 14*a* constructed of non-magnetic material. The magnetic ingredients of the developer are drawn by magnets 14*b* and form ears of the developer on the surface of the revolving sleeve 14*a*, and then the tip of the ears, by rubbing the surface of the photosensitive drum 1 as brush, develops an electrostatic latent image by depositing electrostatic tonner particles on the drum 1.

A cleaning unit 10 comprises a blade 15 for scraping off the residue developer such as electrostatic toner particles from the photosensitive drum 1. The developer thus scraped off flows down along a guide 16 into the lower part of the cleaning unit 10 and then is conveyed by a screw conveyer 17 installed at the bottom of the cleaning unit to a developer recovering device.

Figure 2:
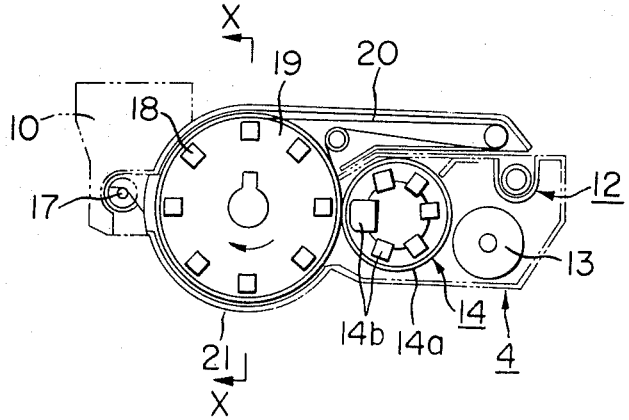
FIG. 2 is a sectional view of a developer recovering device employed in the apparatus illustrated in FIG. 1.
Figure 3:
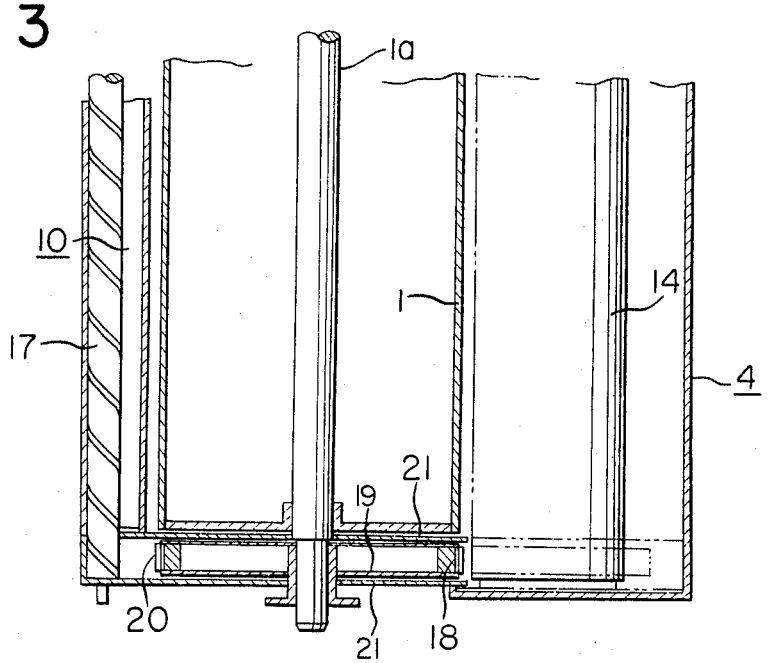
FIG. 3 is a partial top view, partly in section of FIG. 2.

Between the cleaning unit 10 and the developing unit 4 of the aforementioned apparatus, a developer recovering device as illustrated in FIGS. 2 and 3, is installed.

Figure 4:
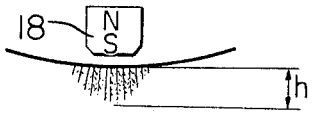
FIG. 4 is a magnified drawing showing the height of ears of a developer.
Figure 5:
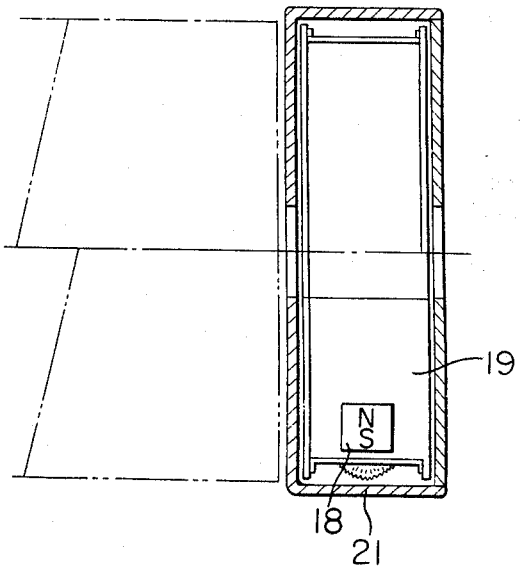
FIG. 5 is a sectional view along line X—X of FIG. 2.

In this illustration, the developer recovering device is for use when the developer is a mixture of a magnetic carrier and electrostatic toner particles. This developer recovering device comprises a revolving element 19 made of a non-magnetic material which revolves coaxially and integrally with the photosensitive drum 1 at the side of the photosensitive drum 1 and is arranged with a plurality of magnets 18 in its internal circumference, a conveyer belt 20 made of a non-magnetic materials for conveying the developer which is collected by the cleaning unit 10 and carried by the screw conveyer 17 to the developing unit 4 by absorbing it on its surface, and a casing 21 which covers at least the external part of the conveyer belt 20 located between the cleaning unit 10 and the developing unit 4. In the developer recovering device, the reason why the developer collected by the cleaning unit 10 can be conveyed by the conveyer belt 20 is that the magnetic brush unit 14 in the developing unit 4 is extended to the position to confront the revolving element 19, the developer is deposited on the surface of the conveyer belt 20, the ears of the developer as illustrated in FIG. 4 or 5 are formed on the surface of the conveyer belt 20 by magnetic attraction of magnets 18 arranged in the revolving element 19, the ears are moved to the cleaning unit 10 side as the conveyer belt 20 moves, and thereby the developer collected by the ears can be caught by the cleaning unit 10 side.

After further advance of the conveyer belt 20 whereby the conveyer belt 20 disengages from the revolving element 19, the developer on the conveyer belt 20 is released from the magnetic of magnets 18 and at the turning point which is above the receiving and distributing unit 12 of the developing unit 4, all developer on the conveyer belt 20 falls into the receiving and distribution unit 12.

For stable and efficient recovery of the developer by the conveyer belt 20 the interval or gap between the surface of the conveyer belt 20 installed in the part of the revolving element 19 below the horizontal line passing through the center of the revolving element 19 and the inner surface of the casing 21 shall be set between not more than 1.5 times the height h of the ears (see FIG. 4) formed on the conveyer belt 20 while the revolving element 19 is at a standstill, preferably not more than 1.2 times or more advantageously, 1.0 times and not less than $\frac{1}{3}$ of the height h preferably not less than $\frac{1}{2}$ of the height h.

When the interval is less than $\frac{1}{3}$ of the height of the ears, during conveyance from the developing unit 4 to the cleaning unit 10, the ears are crushed not only lowering collecting capacity of the developer at the cleaning unit 10, but also clogging may be caused. This minimum interval has bearings on the part above the horizontal line passing through the center of the revolving element 19 when the conveyer belt 20 moves from the cleaning unit 10 to the developing unit 4, and clogging is caused if the interval is less than this minimum interval. Intervals of more than 1.5 times the height of the ears result in lower developer recovery efficiency because of the accumulation of the developer between the conveyer belt 20 and the casing 21. The maximum interval has no bearing on the part above the horizontal line passing through the center of the revolving element 19 through which the conveyer belt 20 moves from the cleaning unit 10 to the developing unit 4.

The above interval shall be 2 to 10 mm or more, preferably 5 to 8 mm when the magnetic power of the surface of the conveyer belt 20 or the revolving element 19 caused by magnets 18 is in a range of 300 to 1,500 Gauss, and it is ascertained that setting of the interval within this range realizes the maximum obtainable recovery efficiency.

The developer recovering device of the present invention as described in the above is for recycling the developer by absorbing (or attracting) and conveying the developer by utilizing magnetism of the magnetic ingredients of the developer and has the excellent advantage of not damaging the developer, consequently preventing deterioration of developing performance.

The present invention may be advantageously applied to the so-called two-component developer in which magnetic ingredients for the photosensitive drum of the electrostatic image reproducing apparatus are mixed with electrostatic toner particles as separate particles, but is not limited to that application alone. As mentioned already, this invention is applicable to so-called one-component magnetic developer in which magnetic ingredients are contained in the electrostatic toner particles. In the system shown in FIG. 2, magnets 18 arranged and positioned in the revolving element 19 need not revolve with the revolving element 19 integrally.

The magnets 18 may be arranged with intervals or gaps as in case of the magnetic brush unit 14. Furthermore, such a system that has a separate unit to pass the developer from the developing unit 4 to the conveyer belt 20 may be provided.

What is claimed is:

1. In an electrostatic image reproducing system including a developing unit (4), a rotatable photosensitive drum (1) arranged to receive developer containing a magnetic ingredient from said developing unit, a cleaning unit (10) arranged to clean said developer off of said photosensitive drum, and a developer recovering device for recycling said developer from said cleaning unit to said developing unit, the improvement wherein said developer recovering device comprises:

developer conveying means including a revolving element (19) made of a non-magnetic material and having an outer surface, and a plurality of magnets (18) arranged adjacent the inner surface of the circumference of said revolving element, and a casing (21) encircling at least a portion of the outer surface of said revolving element (19) with a given spacing therebetween for receiving developer containing said magnetic ingredient;

said revolving element being arranged to pick up said developer from said casing by the magnetic power of said magnets, said picked up developer being conveyed to said developing unit by said revolving element as ears of developer on said revolving element.

2. The electrostatic image reproducing system of claim 1, wherein said developer conveying means further comprises a conveyor belt (20) made of a non-magnetic material and wound around at least a portion of a circumferential surface of said revolving element confronting said casing, said conveyor belt serving as the outer surface of said revolving element at least in the vicinity of said casing.

3. The electrostatic image reproducing system of claim 1, wherein said developing unit (4) includes a magnetic brush unit (14) adjacent to said rotatable photosensitive drum (1), said magnetic brush unit comprising a plurality of magnets (14b) inside a revolving sleeve (14a), and having a portion confronting said revolving element (19); whereby developer is deposited by magnetic power of said magnets (18) of said developer conveying means on the outer surface of said revolving element from said magnetic brush unit as ears of developer, and said ears of developer magnetically pick up developer from said casing.

4. The electrostatic image reproducing system of any one of claims 1, 2 or 3, wherein said given spacing between said casing (21) and said outer surface of said revolving element (19) is not more than 1.5 times of a height of said ears.

5. The electrostatic image reproducing system of any one of claims 1, 2 or 3, wherein said given spacing between said casing (21) and said outer surface of said revolving element (19) is not less than $\frac{1}{3}$ of a height of said ears.

6. The electrostatic image reproducing system of any one of claims 1, 2 or 3, wherein said given spacing between said casing (21) and said outer surface of said revolving element (19) is between 2 to 10 mm when a magnetic power of the surface of said revolving element is in a range of 300 to 1,500 Gauss.

7. The electrostatic image reproducing system of claim 3, wherein said developer conveying means further comprises a conveyor belt (20) made of a non-magnetic material and wound around at least a portion of a circumferential surface of said revolving element confronting said casing, said conveyor belt serving as the outer surface of said revolving element at least in the vicinity of said casing.

8. The electrostatic image reproducing system of claim 7, wherein said given spacing between said casing (21) and said outer surface of said revolving element (19) is not more than 1.5 times of a height of said ears.

9. The electrostatic image reproducing system of claim 7, wherein said given spacing between said casing (21) and said outer surface of said revolving element (19) is not less than $\frac{1}{3}$ of a height of said ears.

10. The electrostatic image reproducing system of claim 7, wherein said given spacing between said casing (21) and said outer surface of said revolving element (19) is between 2 to 10 mm when a magnetic power of the surface of said revolving element is in a range of 300 to 1,500 Gauss.

* * * * *